US005599019A

United States Patent [19]

Davis et al.

[11] Patent Number: 5,599,019

[45] Date of Patent: Feb. 4, 1997

[54] HANDLE PALLET FOR IMPLEMENTS SUCH AS SPORTS RACQUETS

[75] Inventors: Stephen J. Davis, Washington Crossing, Pa.; Richard Janes, Burlington Township, N.J.

[73] Assignee: Prince Sports Group, Inc., Bordentown, N.J.

[21] Appl. No.: 415,348

[22] Filed: Apr. 3, 1995

[51] Int. Cl.[6] ..... A63B 49/08

[52] U.S. Cl. ..... 473/549

[58] Field of Search ..... 273/73 R, 73 J, 273/81 R; 16/110 R; 81/489; 473/300

[56] References Cited

U.S. PATENT DOCUMENTS

| | | | |
|---|---|---|---|
| 1,409,142 | 3/1922 | Gerson | 273/73 J |
| 2,694,538 | 11/1954 | Consolo et al. | 273/81 R X |
| 4,575,082 | 3/1986 | Mott et al. | 273/73 J X |
| 4,641,838 | 2/1987 | Gabrielidis | 273/73 J |
| 4,765,856 | 8/1988 | Doublt | 273/73 J X |
| 5,034,082 | 7/1991 | Nolan | 273/73 J X |

FOREIGN PATENT DOCUMENTS

| | | | |
|---|---|---|---|
| 2662948 | 12/1991 | France | 273/73 A |

*Primary Examiner*—Raleigh W. Chiu
*Attorney, Agent, or Firm*—White & Case

[57] ABSTRACT

A sports racquet, e.g., a tennis racquet, has an elastomeric pallet that slides onto the racquet shaft. The pallet is formed preferably with a pair of opposed axially extending guides formed on opposed interior surfaces of the pallet. Each guide defines a pawl member. The racquet shaft includes a pair of guide grooves, to receive a respective guide and pawl member, and each groove contains a mating ratchet member. When the pallet slides on the shaft, the guides slide along the guide grooves, until the pawl members and ratchet members engage, which locks the pallet at a predetermined position on the shaft against reverse movement. Due to the fact that the pallet can be easily mounted on the shaft, without the need for adhesive or mechanical fasteners, retailers can carry separate inventories of pallets and racquets, and the customer can select the desired pallet model and handle size at the time of purchase.

17 Claims, 7 Drawing Sheets

HANDLE PALLET FOR IMPLEMENTS SUCH AS SPORTS RACQUETS

FIELD OF INVENTION

The present invention relates to handles for implements such as sports racquets, e.g., tennis, squash, racquetball, or badminton racquets. A preferred embodiment of the invention will be described with reference to a tennis racquet.

BACKGROUND OF THE INVENTION

Sports racquet frames include a head, which supports strings for hitting a ball or shuttlecock, and a handle which is gripped by the player to impart the hitting stroke. The handle, which is mounted on a shaft portion of the racquet frame, customarily is octagonal in configuration so as to provide a comfortable gripping surface. Traditionally, the handle included a core of wood, plastic, or other material wrapped with a textured leather or synthetic grip, and was constructed directly on the shaft portion of the frame so that the handle and frame became, for structural purposes, a unitary member.

Tennis racquets come in a variety of different constructions, so as to offer a range of diversity in playing characteristics, e.g. in terms of stiffness, power, weight, balance, maneuverability, and feel. Tennis players choose a racquet depending upon their level of skill and personal preferences. In order to satisfy different players, manufacturers must offer a selection of different racquet models.

In addition to offering a variety of racquet models, it is important that the handle be properly sized relative to the player's hand for comfort and a good grip. Since all tennis players do not have the same size hand, racquet manufacturers must offer each model of racquet in a range of grip sizes. As a practical matter, tennis pro shops and other sporting goods retailers (which normally sell more than one brand) need to stock a substantial inventory of tennis racquets of different models and grip sizes.

Commonly owned Nolan U.S. Pat. No. 5,034,082 recognizes the inventory problem that is created by having to stock tennis racquets in multiple grip sizes. Nolan thus proposes a tennis racquet having a shaft with an octagonal outer surface, and a cushion pallet which has a hollow, octagonal shape inner surface that slides onto the racquet shaft and is secured permanently on the shaft with adhesive.

The racquet handle system disclosed in Nolan permits the pallet to be molded separately from the racquet, which is greatly desirable, and allows the pallet to be mounted on the shaft after manufacture and held securely in permanent engagement with the shaft. However, while such handle pallets could be provided to retailers separate from the racquets, to cut down on the size of inventory, as a practical matter it would be difficult, without proper training, to ensure that retailers mount the pallets properly at the point of sale. There is thus the potential problem that retailers would not adhere the pallets properly on the shaft, leading to customer dissatisfaction. Therefore, commercial racquets that employ slide-on cushion pallets are still assembled at the factory.

As discussed in Nolan, there have been other proposals to make tennis racquets with handles that can be assembled by the retailer or purchaser. Such proposals provide handles which are provided with special mounting constructions so that the handles may slide onto the shank of the tennis racquet frame and be attached by screws. However, due to the considerable forces upon impact of the ball, these prior proposals have been unacceptable from a commercial standpoint, due to the difficulty of designing a mechanical attachment system in which the handle is as securely held, with as solid a feel, as in a unitary structure. Also, screw holes are undesirable because they tend to weaken the frame structure. It would thus be difficult to produce commercially such a racquet in which mechanical attachment systems would not tend to rattle, vibrate, or work themselves loose over time.

It would therefore be desirable to provide a handle system with a separate pallet that could readily and easily be mounted on the handle by the retailer, but which at the same time would be mounted as securely on the shaft as present systems, and which is easily replaceable.

SUMMARY OF THE INVENTION

The present invention is a slide-on pallet for an implement such as a sports racquet, e.g., a tennis racquet, which can be mounted quickly and easily, without the need for adhesives or mechanical fasteners of any kind, and which when mounted is securely held against both axial and twisting movements.

More particularly, a sports racquet according to the invention has a pallet, preferably formed of an elastomeric material, that slides onto the racquet shaft. The pallet interior is formed with at least one, and preferably a pair of outwardly projecting guides, which extend axially and include a pawl member.

The racquet shaft preferably includes a pair of guide grooves on the upper and lower surfaces, to receive the respective guides. Each guide groove contains a ratchet member for engaging a respective pawl member when the pallet reaches a predetermined axial position on the shaft. When the pallet slides on the shaft, the guides are received in the grooves and slide therealong until the pawl reaches the ratchet engagement surface, which engages the pawl to lock the pallet onto the shaft at the predetermined axial position. Moreover, due to the engagement between the outwardly projecting guide and the guide grooves, torsional forces are resisted, thereby preventing twisting of the pallet on the shaft.

Due to the fact that the pallet can be easily mounted on the shaft, without the need for adhesive or mechanical fasteners, retailers can carry separate inventories of pallets and racquets, and the customer can select the desired pallet model and handle size at the time of purchase.

Preferably, the pallet is made of Kraton rubber or other elastomeric materials having a coefficient of friction which is comparable or higher. In accordance with the present invention, by providing a close fit between the pallet and the shaft, and due to the presence of the locking pawl and ratchet members, the pallet remains securely on the handle without buzzes, squeaks and rattles. Due to the ease of attachment of the pallet, and the fact that the pallet may be secured without the need for adhesives, the pallet and racquet assembly also permits a replaceable handle, without the need for moving parts, thereby eliminating the possibility of inadvertent removal and failure to replace any fasteners such as screws, nuts or bolts. The engaging pawl and ratchet members also ensure that the pallet is secured on the handle in an exact location.

For a better understanding of the invention, reference is made to the following detailed description of a preferred embodiment, taken in conjunction with the drawings accompanying the application.

DETAILED DESCRIPTION OF PREFERRED EMBODIMENTS

Figure 1:
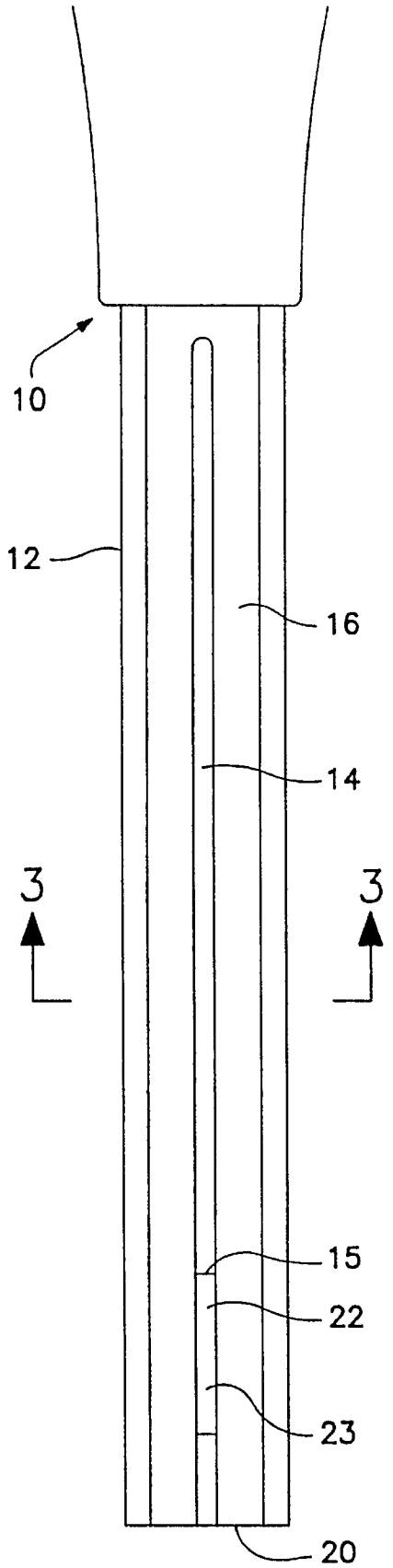
FIG. 1 is a front view of the shaft portion of a tennis racquet frame, prior to mounting a handle pallet.
Figure 3:
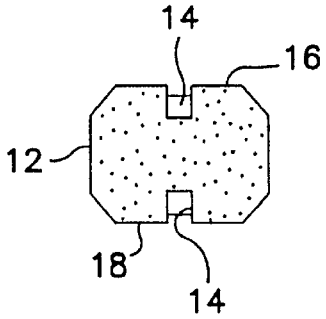
FIG. 3 is a cross-sectional view of the shaft, taken through lines 3—3 of FIG. 1.

FIG. 1 shows a tennis racquet frame 10, which includes a generally octagonal shaft 12 for supporting a handle. The shaft 12 may be solid, as shown in FIG. 3, or may be hollow. A pair of longitudinal guide grooves 14, formed in opposed top 16 and bottom 18 surfaces of the shaft 12, extend axially from the butt end 20 of the shaft 12 essentially the length thereof. The bottom of each groove 14 includes a ratchet member 22, oriented so that the engaging tooth surface 15 is oriented to face in a direction away from the butt end 20, and that the ramp surface 23 of the ratchet member 22 tapers toward the butt end 20. As shown, the ramp surfaces 23 have a sudden drop off at the engagement surface 15. As described below, these ramp surfaces ease the cushion pallet over the shaft, and the drop off locks the pallet in place, preventing reverse movement. The upper end of the shaft 12 also includes an outwardly extending flange 70.

The frame 10 may be formed in a conventional process in which a composite tubular prepreg, formed of reinforcing carbon fibers and uncured epoxy, is placed in a heated mold in the shape of a tennis racquet. A bladder, extending inside the prepreg tube is inflated so that the prepreg conforms to the shape of the mold as the epoxy cures. Alternatively, a thermoplastic tennis racquet frame may be made according to the molding process disclosed in commonly owned U.S. Pat. No. 5,176,868. The invention may be used with racquets formed of other materials, such as other composites or metal shafts, as well. In each case, the shaft outer surface is shaped so as to form the grooves 14 and ratchet forming surfaces 23, 15.

Figure 4:
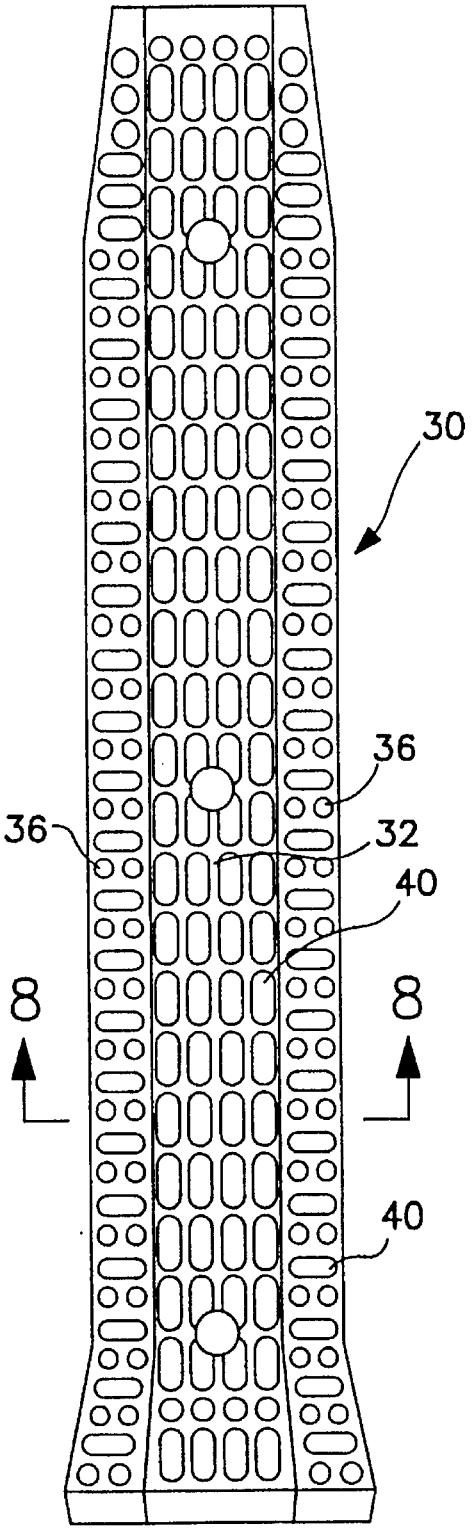
FIGS. 4 and 5 are front and side views, respectively, of a handle pallet for use on the shaft of FIGS. 1–3.
Figure 5:
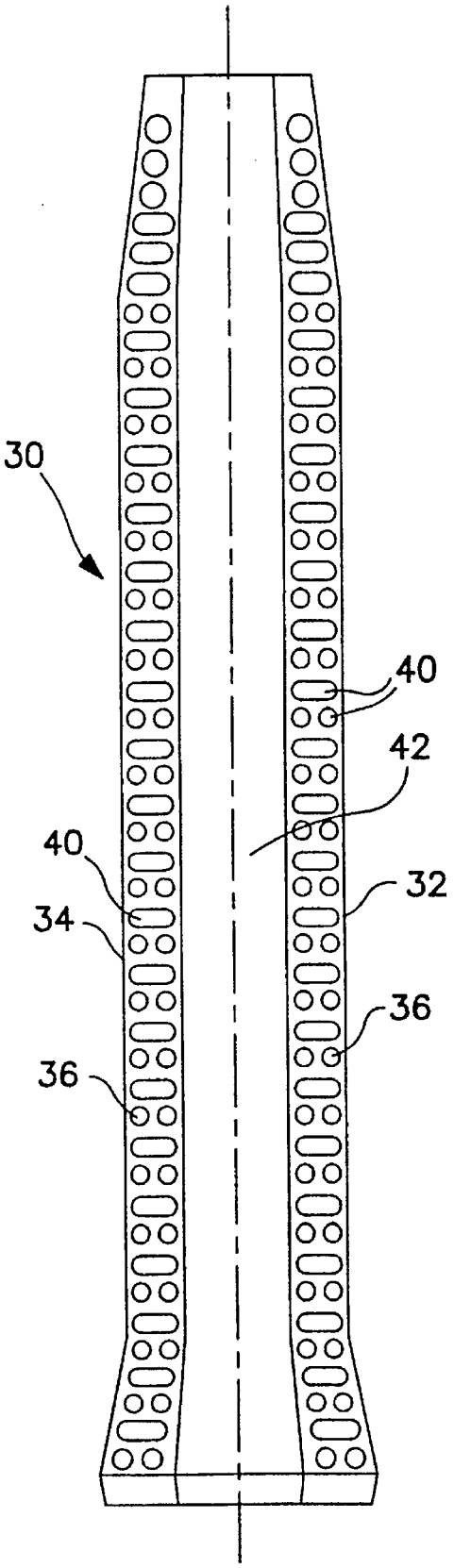
Figure 6:
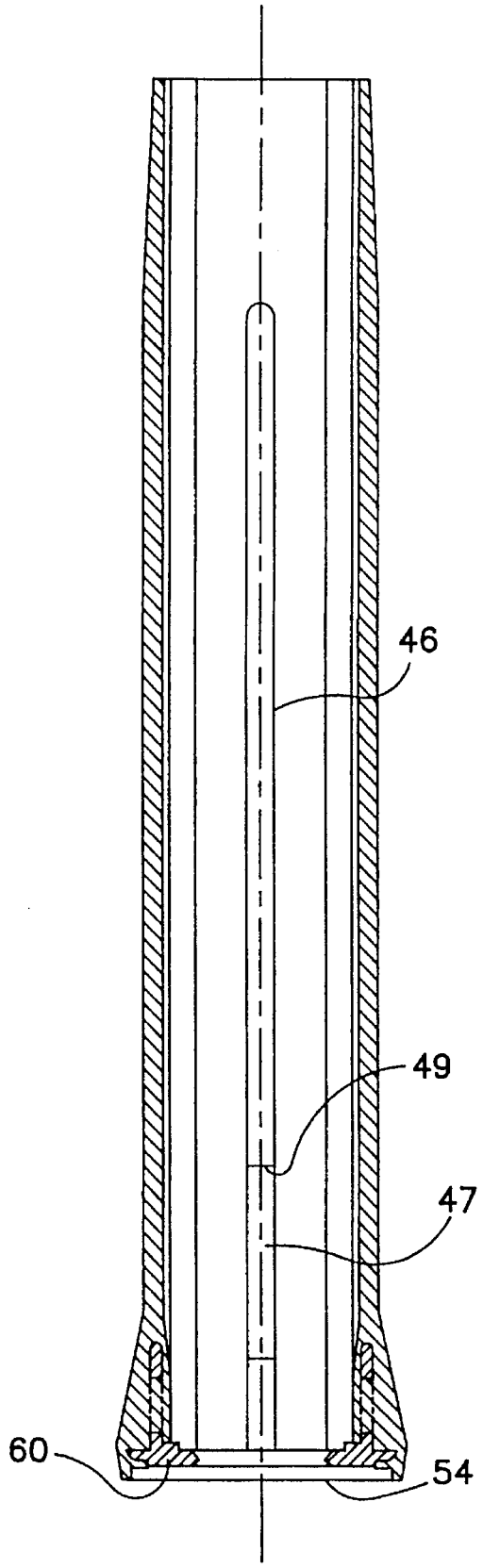
FIGS. 6 and 7 are front and side views of the pallet, shown in longitudinal section.

FIGS. 4 and 5 show an elastomeric pallet 30 having a generally octagonal outer surface. The top 32, bottom 34 (FIG. 8), and diagonal 36 outside surfaces are provided with a plurality of holes 40 in order to reduce the weight of the pallet 30 and soften the pallet in selected areas. Preferably, the sides 42 of the pallet do not contain holes. Such a pallet is described further in Davis et al. U.S. patent application Ser. No. 07/373,331. The cushioned pallet shown in FIGS. 4–5 is an example of a pallet that may be used with the present invention. However, cushion pallets without holes or using other hole patterns, or pallets made of other materials such as elastomeric, foam, plastic, may be used as well.

Figure 8:
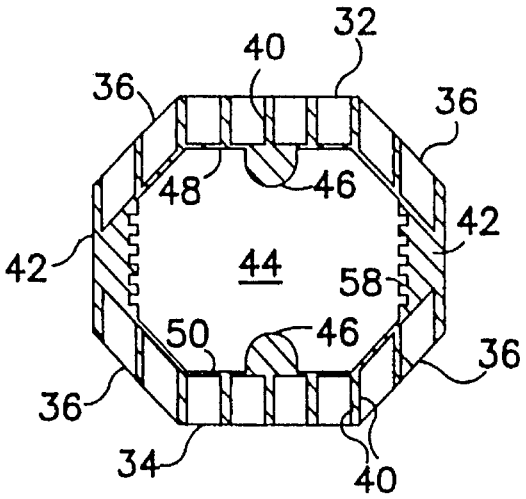
FIG. 8 is cross sectional view of the pallet, taken through lines 8—8 of FIG. 4.

As shown in FIG. 8, the pallet 30 has an octagonal shape, hollow interior 44, which corresponds to the octagonal outer shape of the shaft 12. It is not necessary that the shaft and pallet interior be given an octagonal shape, but the two members should have corresponding shapes so that the shaft may slide into the pallet interior 44 and so that the outer surfaces of the shaft 12 abut snugly against the corresponding surfaces of the pallet interior 44 and prevent any relative twisting movement.

The upper interior surface 48 and the lower interior surface 50 of the pallet 30 each are formed with a longitudinally extending, outwardly projecting, guide 46. Each guide 46 includes a pawl member 47, which is oriented so that the pawl tooth surface 49 is facing toward the butt end 54 of the pallet 30. The opposed guides 46 are sized and shaped, as shown in FIG. 8, so as to fit into the grooves 14 in the shaft 12.

Figure 7:
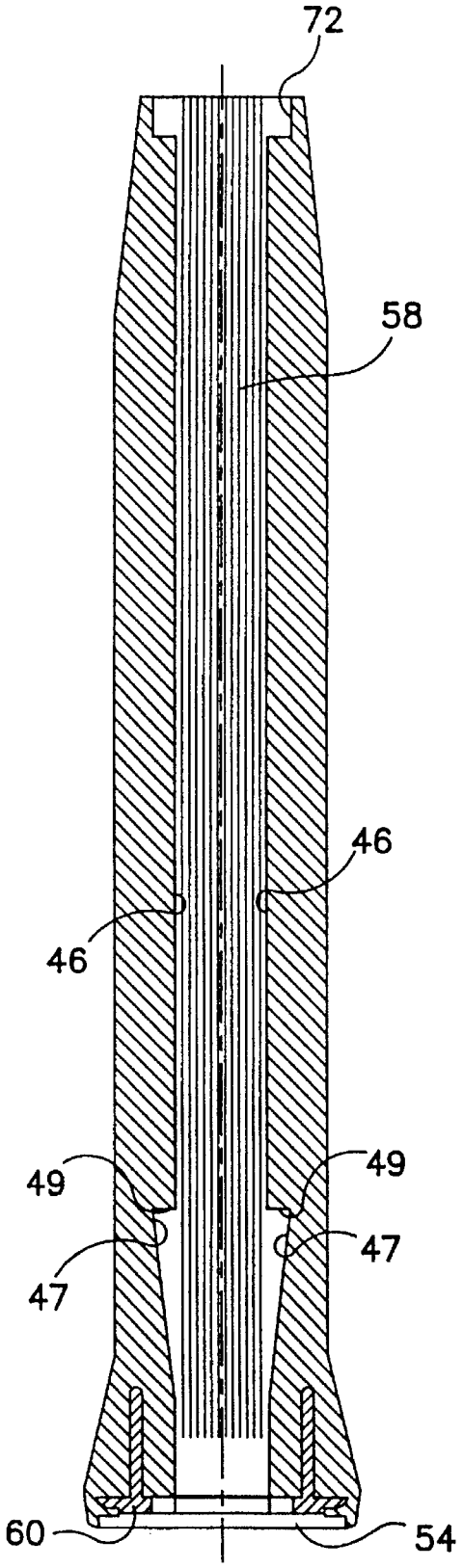

As also shown in FIGS. 7–8, if desired one or more interior surfaces of the pallet 30 may include shallow grooves 58, whose purpose is to reduce the weight of the pallet 30. Also, if desired a hard butt cap 60 may be molded in to the butt end 54. Also, the forward end of the pallet includes a seat 72, which is shaped to receive flange 70 on the shaft 12.

The pallet is preferably made of thermoplastic rubber such as Kraton, which is a thermoplastic rubber with polyproplyene fillers to vary hardness, sold by the Shell Oil Company. Most preferably, Kraton G2750, having a durometer of Shore A 63, is used. It is desirable that, if pallet materials other than Kraton rubber are chosen, such materials have a coefficient of friction comparable to, or higher than Kraton. The guide groove 14 and the guides 46 are preferably provided along the top and bottom surfaces, however, such members can be alternatively be provided along other surfaces, e.g., along the sides. Preferably, the pallet is sized for a friction fit about the shaft exterior surface, but not so tightly as to bind when the retailer or customer slides the pallet onto the shaft. Also, the guides 46 are sized to fit snugly against the sides of the groove 14, but as shown in FIG. 9, preferably there is clearance between the bottom of the groove 14 and the guides 46.

Figure 9:
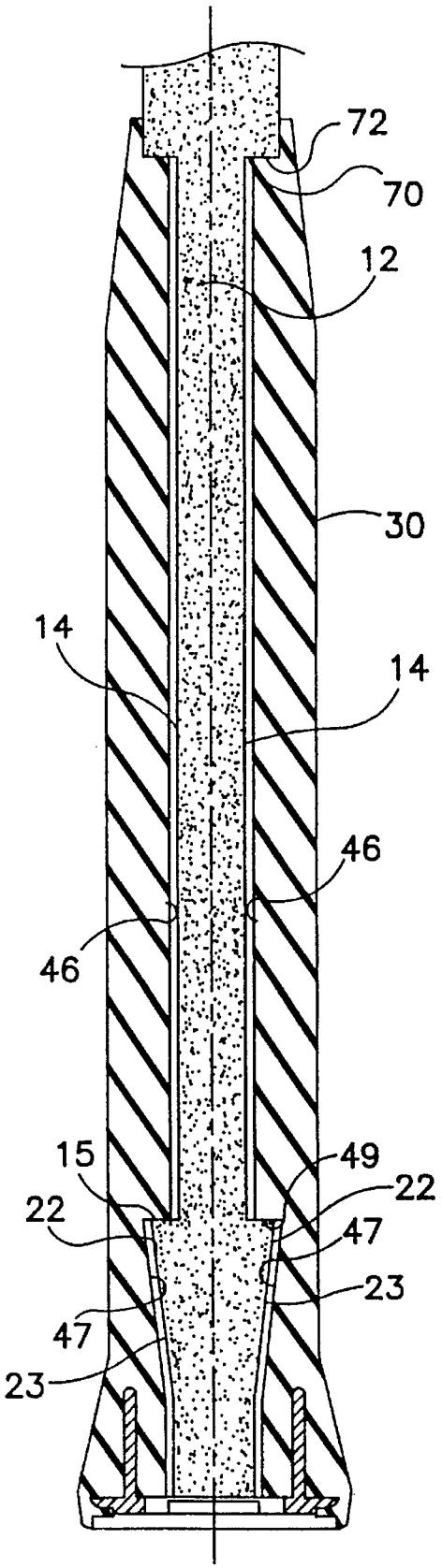
FIG. 9 is longitudinal sectional view of the pallet as mounted on the shaft.

As shown in FIG. 9, to complete the assembly of the tennis racquet 10, the cushion pallet 30 slides over the racquet shaft 12, such that the shaft 12 is received in the pallet interior 44. The opposed protruding guides 46 are received in the opposed guide grooves 14. As the pallet 30 slides up the shaft 12, due to the compressibility and elasticity of the pallet material, the ramp surfaces 23 of the ratchet members 22 push the opposed guides 46 outwardly, until they pass by the engaging surfaces 15 of the ratchet member, whereupon they can expand into the groove 14. When the pawl tooth surface 49 reaches the ratchet tooth surface 15, it snaps into engagement as shown in FIG. 9, locking the pallet in place. The pallet may then be wrapped with a grip in the customary manner.

As shown in FIG. 9, each pawl 47 includes a tapered surface mirroring the ramp surface 23 of its respective ratchet member 22, but with slight clearance. Moreover, the engagement between the flange 70 on the upper end of the shaft 12 and the pallet upper seat 72 prevents the pallet from being pushed onto the shaft beyond the predetermined position. Thus, the pawl and ratchet pairs prevent the pallet from being pulled off the shaft, whereas the flange 70 and seat 72 prevent any further movement away from the butt end.

The event which would tend to cause the greatest movement between a pallet and the shaft is the swing and impact with the ball. The centrifugal force from swinging the racquet, and ball impact, both tend to pull the racquet shaft out of the pallet. With the present invention, the pallet is mechanically locked against movement in this direction, and therefore remains very securely in place. The friction between the Kraton material and the composite shaft also helps prevent any other undesirable movement of the pallet. In this manner, the pallet can be mounted on the shaft without using any adhesive, screws or other fasteners and will feel securely mounted to the player. Wrapping the pallet with a grip will also help secure the pallet to the handle to prevent movement.

The present invention permits racquet pallets to be mounted on the racquet quickly and easily. Moreover, the invention permits racquets and pallets which are of different handle sizes, or different styles, to be shipped separately, and assembled by the retailer. By being able to select the pallet size or style at the time of purchase, a retailer can carry a smaller inventory of racquets, and still offer each racquet model in a full range of grip sizes and styles for each model.

Moreover, the present invention provides both the manufacturer and the customer with greater flexibility. The manufacturer is no longer limited to offering only a single style of pallet for each racquet model. Rather, the manufacturer can offer a variety of pallet models, e.g., of varying softness or shapes, allowing the customer to choose not only the racquet model but also to choose the desired type of pallet. Moreover, if the customer decides after purchase to replace the initial pallet, either because the customer wants a different grip size or decides to try a different style pallet, the present invention allows the pallet to be changed easily. All the player or retailer need do to remove the existing pallet is to slice it lengthwise and pull it off the shaft. Thereafter, a replacement pallet can readily be slid onto the shaft and re-wrapped with a grip. Alternatively, a tool could be inserted to unlock the pawl and ratchet members, in order to allow the pallet to be retracted from the handle shaft.

Figure 10:
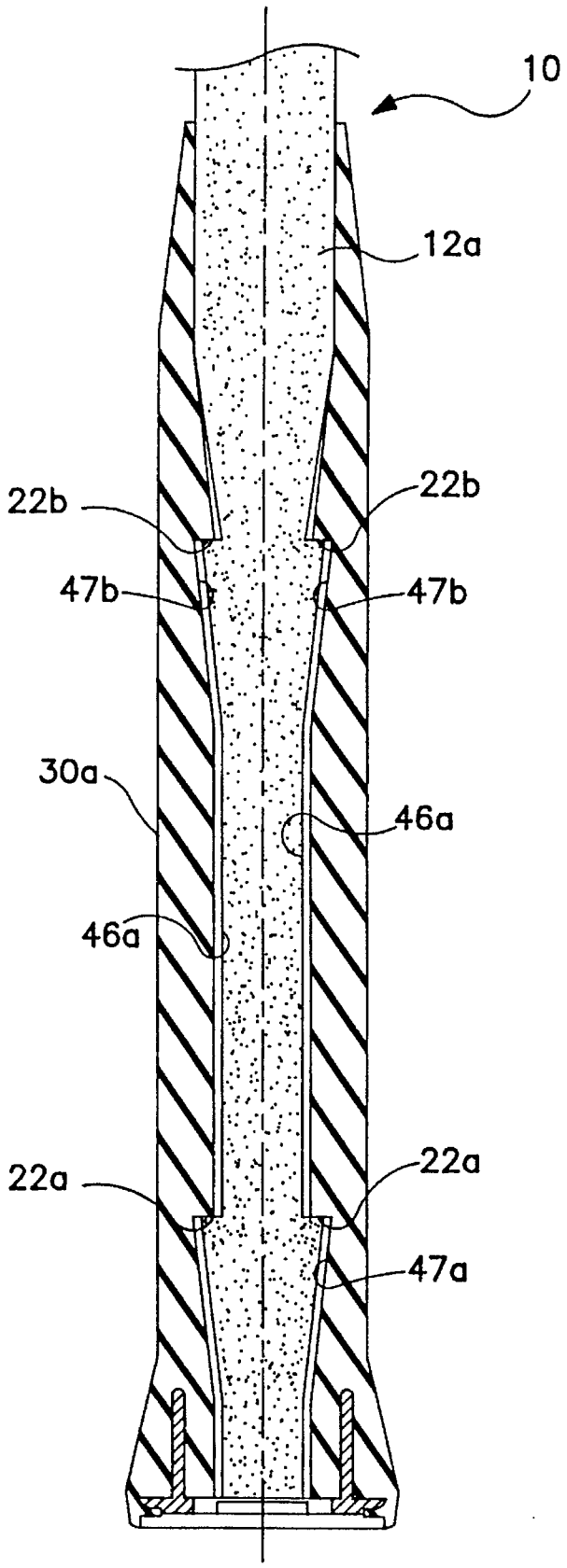
FIG. 10 is a longitudinal sectional view, corresponding to FIG. 9, of an alternative embodiment of the invention.
Figure 11:
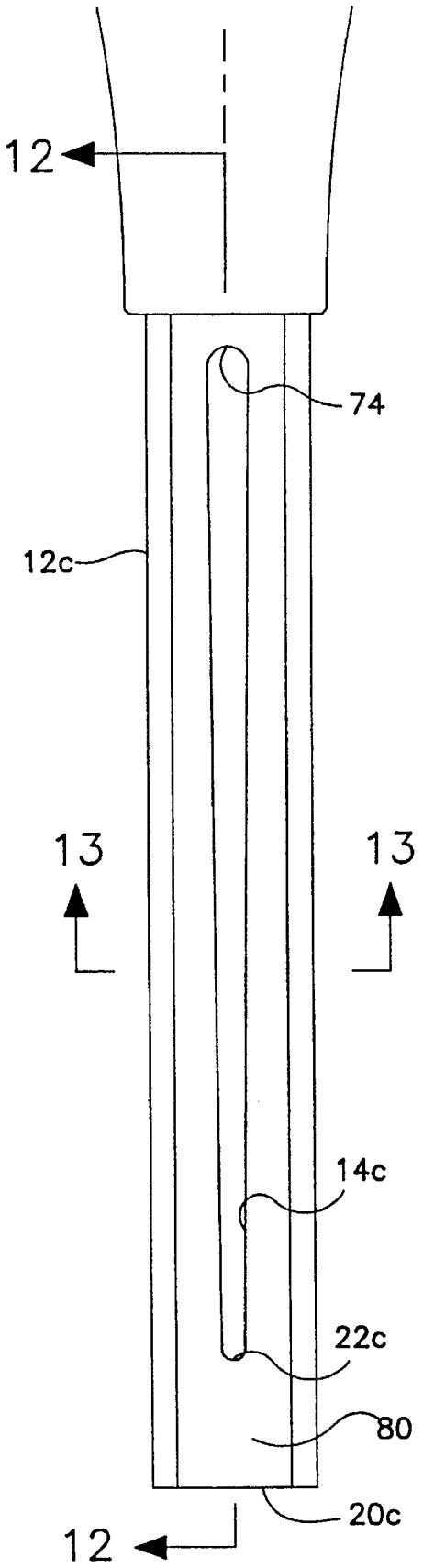
FIG. 11 is a front view of the shaft portion of an alternative embodiment of a tennis racquet frame, prior to mounting a handle pallet.
Figure 12:
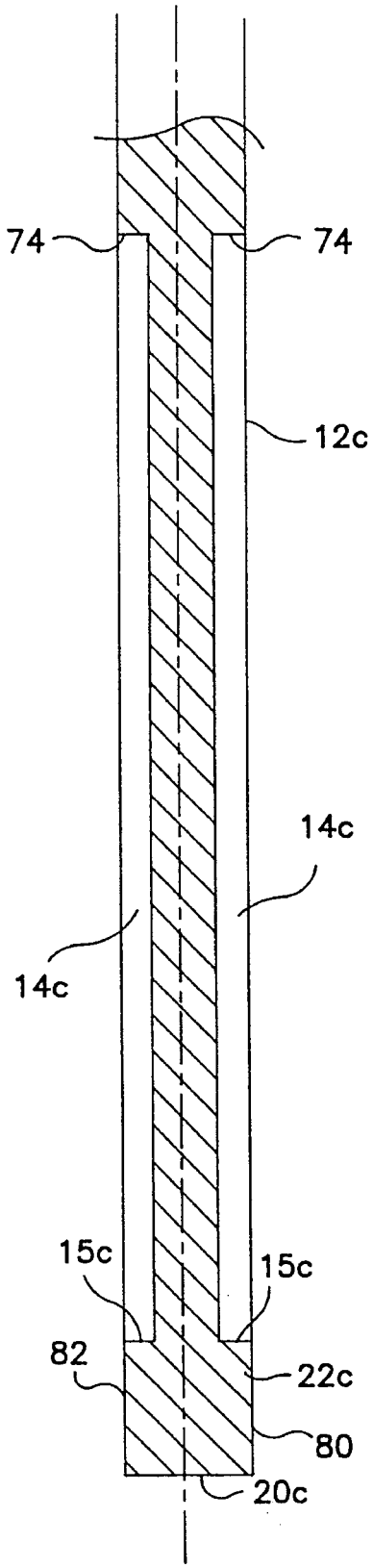
FIG. 12 is a side view, partially in section, of the shaft of FIG. 11.
Figure 13:
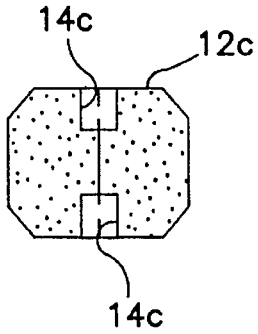
FIG. 13 is a cross-sectional view of the shaft, taken through lines 13—13 of FIG. 11.
Figure 14:
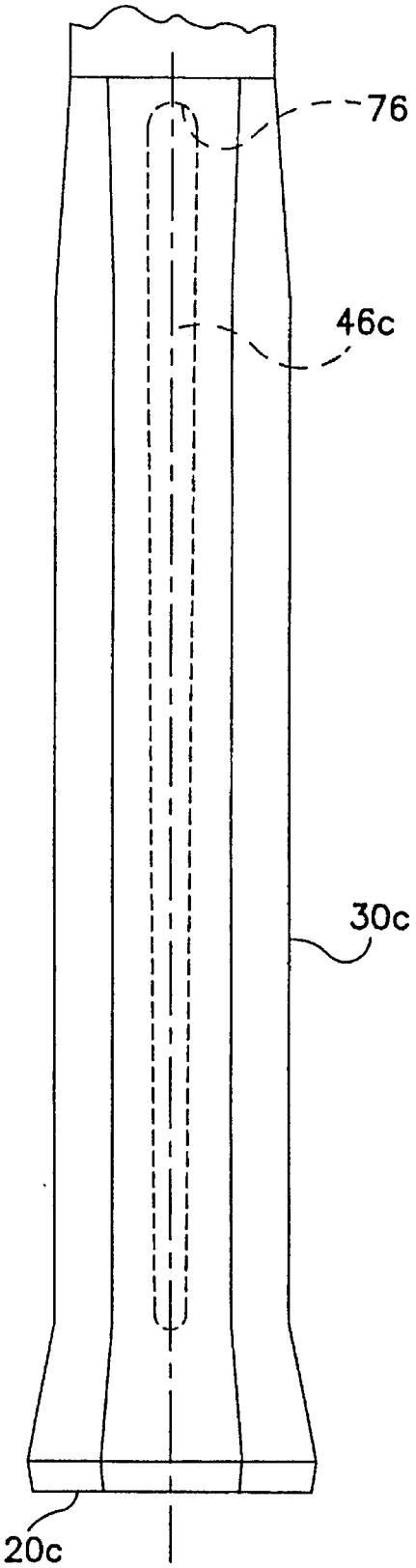
FIGS. 14 and 15 are front and side views, respectively, of a handle pallet mounted on the shaft of FIGS. 11–13.

FIG. 10 shows an alternative embodiment in which, instead of having a single ratchet member in each guide groove, and a single pawl member on the opposed inner surfaces of the pallet 30*a*, each guide groove contains a pair of ratchet members 22*a*, 22*b*, located at axially spaced locations near the top and the bottom of the shaft 12*a*, and the protruding guides 46*a* on the interior upper and lower surfaces each have a pair of pawl members 47*a*, 47*b* mating with the corresponding ratchet members on the shaft 12*a*.

Figure 2:
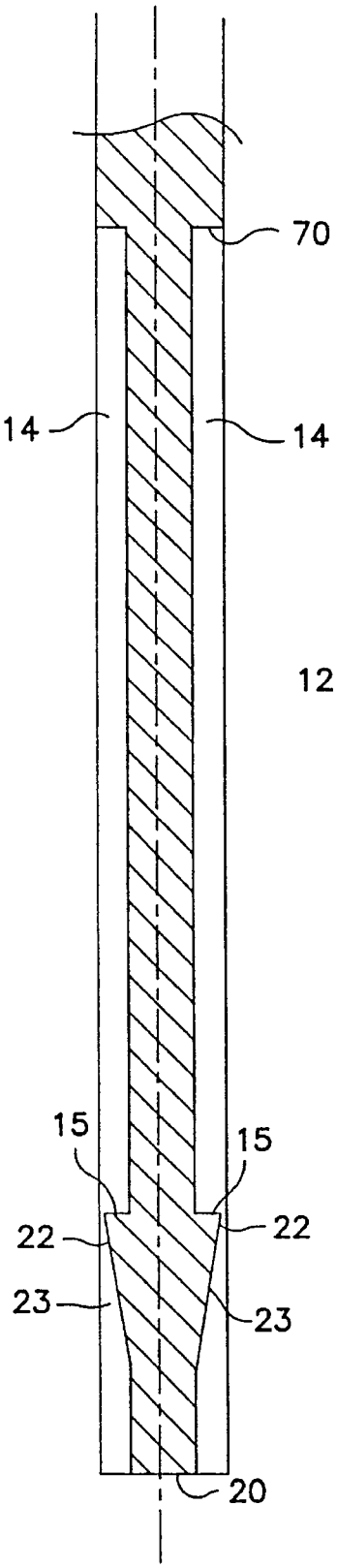
FIG. 2 is a side view, partially in section, of the shaft of FIG. 1.

In the alternative embodiment shown in FIGS. 11–15, the shaft 12*c* has a tapered groove 14*c* formed in the upper and lower surfaces substantially along its length. The groove 14*c* is preferably tapered so that its width increases in a direction away from the butt end 20*c*. Each groove has a ratchet portion 22*c*, including a ratchet tooth surface 15*c* facing away from the butt end 20*c*. Unlike the embodiment of FIGS. 1–3, however, the ratchet tooth surface 15*c* is not preceded by a ramp surface. The groove 14*c* also includes a forward end wall 74.

The pallet 30*c* is similar to pallet 30, except that the protruding longitudinal guides 46*c*, which similar to pallet 30 are formed along the upper and lower interior surfaces of the pallet, are tapered in width, to conform in shape to the tapered guide grooves 14*c*. Each guide 14*c* includes a pawl member 47*c* that is located to engage the ratchet tooth surface 15*c* of a respective ratchet portion 22*c*, and also includes a forward end 76 that engages the forward end wall 74 of the guide groove 14*c*.

Figure 15:
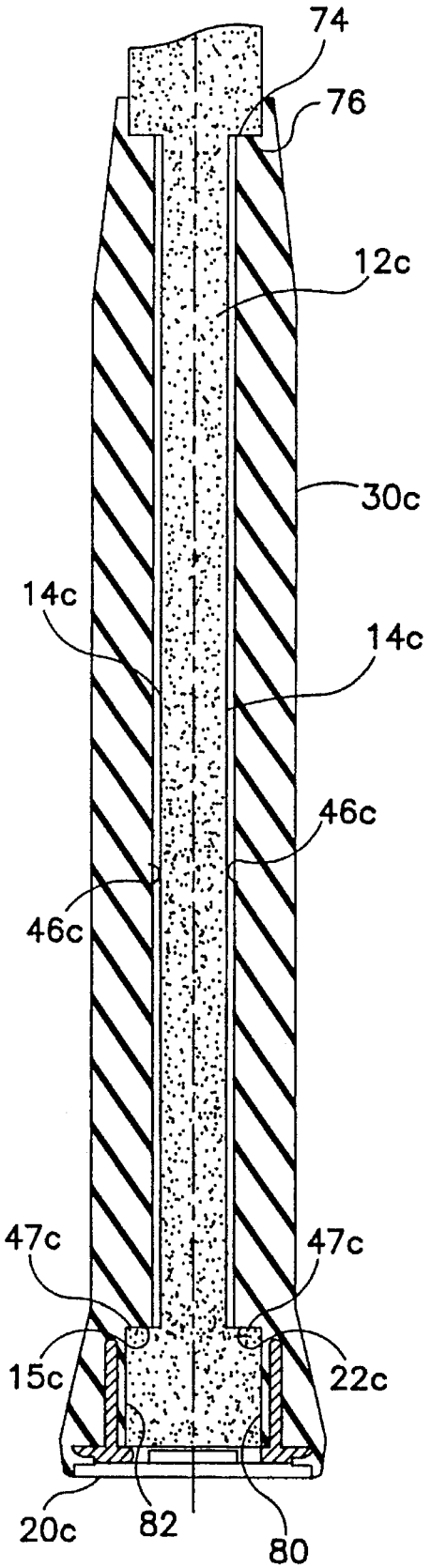

The pallet 30*c* slides onto the shaft 12*c*. As shown in FIG. 15, the top and bottom surfaces 80, 82 of the shaft 12*c*, prior to reaching the groove 14*c*, are spaced apart from one another a greater distance than the opposed protruding guides 46*c*, which must be spread apart to pass over surfaces 80, 82. Also, due to the taper of the guide groove and protruding guide member, the guide member 46*c* will be too wide to fit into groove 14*c* as the pallet 30*c* is being slid onto the shaft 12*c*. Once the pallet 30*c* reaches the position shown in FIGS. 14–15, however, the opposed guide members 46*c* will snap into the grooves 14*c*. Thereafter, the pawl member 47*c*, and also the taper of the guide and groove, will prevent the pallet 30*c* from moving (unintentionally) toward the butt end 20*c*. The abutting forward end 76 of the guide member 47*c* and forward end wall 74 of the groove 14*c* will similarly prevent any unintended movement of the pallet 30*c* away from the butt end 20*c*.

The foregoing represents the preferred embodiments of the invention. Variations and modifications will be apparent to persons skilled in the art, without departing from the inventive concepts disclosed herein. For example, although the preferred pallet is made of an elastomeric material, the only portions of the pallet that need to be deformable, in order to slide the pallet on the shaft, are the protruding guide members. Thus, it would be possible to make a hard pallet, and use pawl members 46 which are either elastomeric themselves, or which are mounted to the pallet in a manner so as to be deformable when sliding the pallet onto the shaft 12. Such resilient pawl member can be secured to the pallet using known insert molding techniques. Moreover, while in the exemplary embodiment the guide grooves are formed in the shaft, and the projecting guides are formed on the pallet, the reverse may be done. All such modifications and variations are intended to be within the skill of the art, as defined in the following claims.

I claim:

1. A handle pallet for use on an implement having a shaft with a butt end and an outer surface which is generally uniform for a distance from said butt end, said pallet comprising a molded, elastomeric sleeve defining a hollow interior with at least one open end, wherein said sleeve, at least over a substantial portion of its length, is defined by a wall that, in cross-section, extends continuously around said hollow interior, wherein said hollow interior has a shape which is generally uniform for a distance from said open end along a central axis, and wherein said molded sleeve further includes a first pawl member, located in said hollow interior, having an engaging surface for engaging a ratchet member on a shaft; whereby when said pallet is slid onto a shaft having a cooperating ratchet member, said pawl member, by virtue of said sleeve being elastomeric, is displaceable away from said axis in order to move into interlocking engagement with the cooperating ratchet member.

2. A handle pallet according to claim 1, wherein said molded sleeve defines opposed first and second interior surfaces, and further comprising an axially extending first guide located on said first interior surface and projecting from said surface toward said central axis, wherein said first guide extends along at least a substantial portion of the length of said hollow interior, and wherein said first guide includes a portion defining said first pawl member, such that said guide may be slidingly received in a groove formed in a shaft and such that the first pawl member moves into interlocking engagement with a ratchet member formed in the groove of such shaft.

3. A handle pallet according to claim 2, wherein said sleeve includes a second, axially extending guide, similar to said first guide, located on said second interior surface and containing a portion defining a second pawl member, wherein said first and second guides may be slidingly received in a pair of opposed grooves on a shaft such that said first and second pawl members move into interlocking engagement with a pair of ratchet members formed in the respective grooves of such shaft.

4. An implement comprising:

a shaft with a butt end, an outer surface which is generally uniform for a distance from said butt end, and a first engagement member on said outer surface; and a pallet comprising a molded, elastomeric sleeve defining a hollow interior with at least one open end, wherein said sleeve, at least over a substantial portion of its length, is defined by a wall that, in cross-section, extends continuously around said hollow interior, wherein said hollow interior has a shape which is generally uniform for a distance from said open end along a central axis and which conforms generally to said outer surface of said shaft such that said pallet is slidable onto said shaft; and wherein said molded sleeve further comprises a second engagement member, located in said hollow interior, having an engaging surface for interlocking engagement with said first engagement member when said pallet reaches a predetermined axial position along said shaft, said second engagement member, by virtue of said molded sleeve being elastomeric, being displaceable away from said axis as said pallet slides along said shaft until said first engagement member reaches a predetermined position for interlocking engagement with said first engagement member.

5. An implement according to claim 4, wherein said first engagement member comprises a first ratchet member having an engagement surface, and wherein said second engagement member comprises a first pawl member.

6. An implement according to claim 5, wherein said molded sleeve defines opposed first and second interior surfaces, and further comprising an axially extending first guide located on said first interior surface and projecting from said surface toward said central axis, wherein said guide extends along at least a substantial portion of the length of said hollow interior, and wherein said first guide includes a portion defining said first pawl member; and wherein said shaft contains a first guide groove having a bottom surface and extending axially from said butt end for receiving, in sliding engagement, said first guide, and wherein said first ratchet member forms at least a portion of the bottom surface of said first guide groove.

7. An implement according to claim 6, wherein said sleeve includes a second, axially extending guide, similar to said first guide, located on said second interior surface and containing a portion defining a second pawl member, wherein said shaft contains a second, axially extending guide groove for receiving, in sliding engagement, said second guide, and wherein said second guide groove contains a second ratchet member for engaging said second pawl member.

8. An implement according to claim 7, wherein each said guide includes only a single pawl member and each said guide groove contains a single ratchet member having only one engagement surface.

9. An implement according to claim 7, wherein said guides include a third pawl member and a fourth pawl member, axially aligned with said first and second pawl members, respectively, and wherein said shaft includes third and fourth ratchet members, forming a portion of the bottom surface of said first and second guide grooves, respectively, wherein said third and fourth pawl members are opposed to said third and fourth ratchet members for engaging said members, the pawl and ratchet members thereby securing the pallet member on the shaft at axially spaced locations.

10. An implement according to claim 4, wherein said first engagement member comprises an axially extending groove in said shaft, said groove having axially opposed ends and a width that increases at an increasing distance from said butt end; and wherein said second engagement member comprises an axially extending guide projecting from an interior surface of said molded sleeve toward said central axis, and having a length and varying width corresponding to said groove, for interlocking with said groove when said pallet reaches a predetermined position along said shaft.

11. A sports racquet comprising:

a shaft having a butt end, an outer surface which is generally uniform for a distance from said butt end, and a first engagement member on said outer surface; and a pallet comprising a molded, elastomeric sleeve defining a hollow interior with at least one open end, wherein said sleeve, at least over a substantial portion of its length, is defined by a wall that, in cross-section, extends continuously around said hollow interior, wherein said hollow interior has a shape which is generally uniform for a distance from said open end along a central axis and which conforms generally to said outer surface of said shaft such that said pallet is slidable onto said shaft; and wherein said molded sleeve further comprises a second engagement member, located in said hollow interior, having an engaging surface for interlocking engagement with said first engagement member when said pallet reaches a predetermined axial position along said shaft, said second engagement member, by virtue of said molded sleeve being elastomeric, being displaceable away from said axis as said pallet slides along said shaft until said first engagement member reaches a predetermined position for interlocking engagement with said first engagement member; and a grip disposed over said pallet.

12. A sports racquet according to claim 11, wherein said shaft is made of composite material, wherein said first engagement member comprises a first ratchet member having an engagement surface, and wherein said second engagement member comprises a first pawl member.

13. A sports racquet according to claim 12, wherein said molded sleeve defines opposed first and second interior surfaces, and further comprising an axially extending first guide located on said first interior surface and projecting from said surface toward said central axis, wherein said guide extends along at least a substantial portion of the length of said hollow interior, and wherein said first guide includes a portion defining said first pawl member; and wherein said shaft contains a first guide groove having a bottom surface and extending axially from said butt end for receiving, in sliding engagement, said first guide, and wherein said first ratchet member forms at least a portion of the bottom surface of said first guide groove.

14. A sports racquet according to claim 13, wherein said sleeve includes a second, axially extending guide, similar to said first guide, located on said second interior surface and containing a portion defining a second pawl member, wherein said shaft contains a second, axially extending guide groove for receiving, in sliding engagement, said second guide, and wherein said second guide groove contains a second ratchet member for engaging said second pawl member.

15. An implement according to claim 14, wherein each said guide includes only a single pawl member and each said guide groove contains a single ratchet member having only one engagement surface.

16. A sports racquet according to claim 14, wherein said guides define a third pawl member and a fourth pawl member, axially aligned with said first and second pawl members, respectively, and wherein said shaft includes third and fourth ratchet members, forming a portion of the bottom surface of said guide grooves, wherein said third and fourth pawl members are opposed to said third and fourth ratchet members for engaging said members, the pawl and ratchet members thereby securing the pallet member on the shaft at axially spaced locations.

17. A sports racquet according to claim 11, wherein said first engagement member comprises an axially extending groove in said shaft, said groove having axially opposed ends and a width that increases at an increasing distance from said butt end; and wherein said second engagement member comprises an axially extending guide projecting from an interior surface of said molded sleeve toward said central axis, and having a length and varying width corresponding to said groove, for interlocking with said groove when said pallet reaches a predetermined position along said shaft.

* * * * *